United States Patent [19]

Van Vliet et al.

[11] 3,974,574

[45] Aug. 17, 1976

[54] CENTRIFUGAL DRYING MILL

[75] Inventors: Edward Van Vliet; George W. Fendler, both of Doylestown; Lynn Himmelberger, Harleysville, all of Pa.

[73] Assignee: Fluid Energy Processing & Equipment Co., Hatfield, Pa.

[22] Filed: Mar. 10, 1975

[21] Appl. No.: 556,643

[52] U.S. Cl. ..... 34/57 E; 34/10; 34/60

[51] Int. Cl.[2] ..... F26B 15/00; F26B 17/00

[58] Field of Search ..... 34/8, 10, 12, 57 E, 34/60

[56] References Cited

UNITED STATES PATENTS

| | | | |
|---|---|---|---|
| 2,351,091 | 6/1944 | Bar | 34/57 E |
| 3,403,451 | 10/1968 | Stephanoff | 34/10 |
| 3,667,131 | 6/1972 | Stephanoff | 34/10 |

*Primary Examiner*—John J. Camby
*Attorney, Agent, or Firm*—Arthur A. Jacobs

[57] ABSTRACT

A centrifugal type drying mill for wet particles in which hot gases are propelled into the mill to entrain and disperse the wet particles and carry them through an arcuate centrifugal path wherein the lighter, drier particles are centrifugally separated from the heavier, wetter particles and centripetally exhausted from the mill, the mill being formed of square or rectangular cross-sectional shape throughout the major portion thereof, with the inlet or drying chamber being of trapezoidal cross-sectional shape, with the narrower wall thereof at the bottom wherein gaseous inlet nozzles are located, the gaseous inlet nozzles being of rectangular shape to extend across the width of the inlet chamber and being provided with valve means therein to permit adjustment of the angles of entry of the gases into the inlet chamber.

5 Claims, 6 Drawing Figures

FIG.1
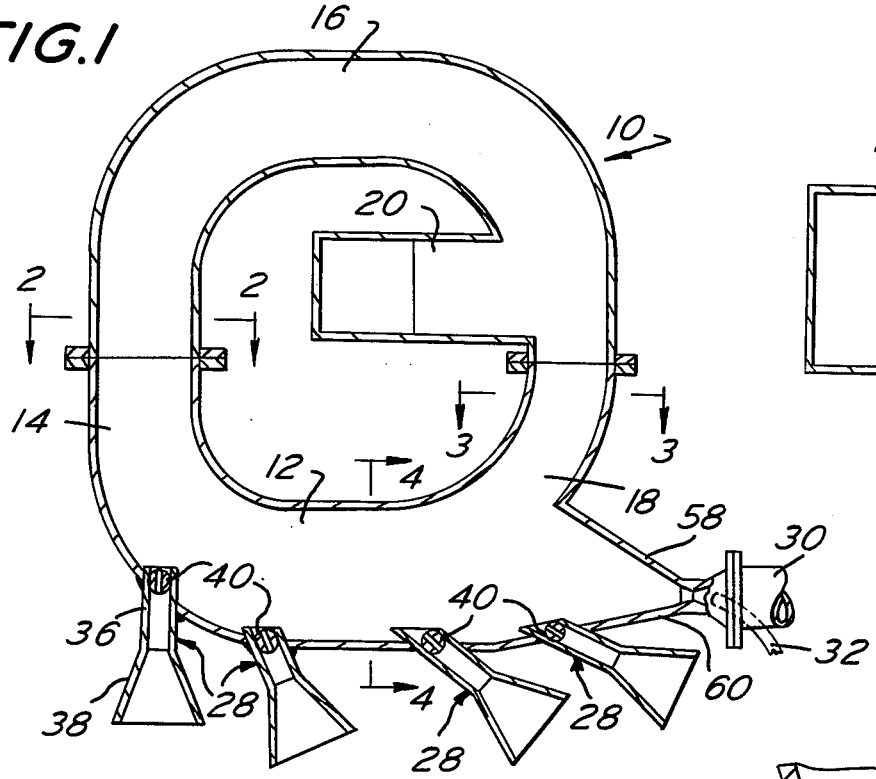
FIG.2
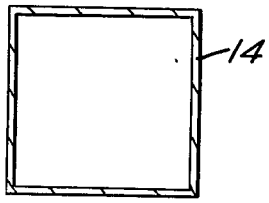
FIG.3
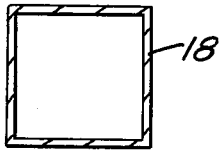
FIG.6
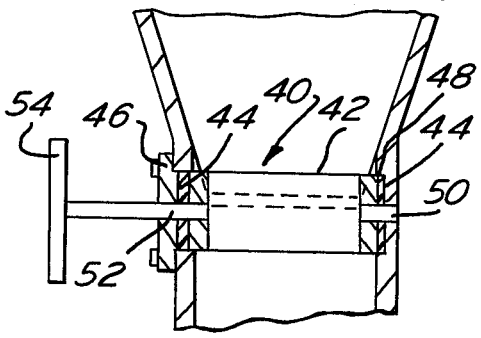
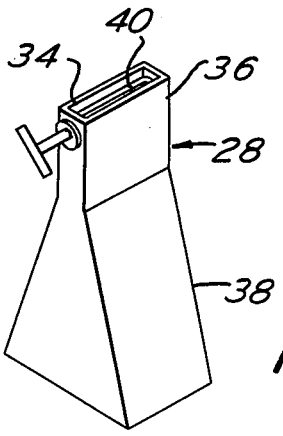
FIG.5
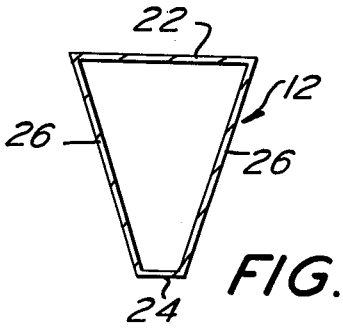
FIG.4

CENTRIFUGAL DRYING MILL

This invention relates to drying mills for drying wet particles, and it particularly relates to drying mills of the centrifugal type.

Drying mills of this type comprise an inlet chamber which is adapted to receive wet particles, such as a slurry or the like, and which is provided with a series of angular gaseous fluid inlet nozzles connected to a source of hot gaseous fluid. The wet particles are fed into one end of the inlet chamber, preferably in the form of an atomized spray, and are entrained in the gaseous fluid. The opposite end of the inlet chamber is connected to an upstack which is itself connected to a classification section. The classification section is connected to a downstack which leads into the inlet chamber adjacent the particle feed inlet. Between the classification section and the downstack, on the inner periphery, is an exhaust port. The upstack, classification section and downstack form a generally arcuate path.

As the particles are entrained in the hot angularly-directed gases, they are whirled in a centrifugal action through the generally arcuate path leading from the upstack to the classification section, at which time a large proportion of the particles are completely dried while some are only partially dried. The completely dried particles, being lighter, whirl around in the inner portion of the centrifugal path while the less dry particles, being heavier, whirl around in the outer portion of the centrifugal path. Such separation or classification is effected primarily in the classification section, so that as the particles descend into the downstack, the lighter particles in the inner centrifugal portion pass through the exhaust port while the heavier particles pass down through the downstack into the inlet chamber where they mix with fresh feed and are again entrained by the hot gaseous fluid and recycled through the mill.

Although the aforesaid type of drying mill is generally very satisfactory, there are some dead spaces usually present in the drying or inlet chamber where accumulation of particles may occur so that they eventually build up and clog the mill. The construction of the gaseous fluid nozzles in these prior mills is also such that the entering gaseous fluid does not flow out into the entire chamber area but are concentrated in a generally round or cylindrical jet so that dead spaces remain around the jet where a partial vacuum is formed and deposition of agglomerated particles occurs. In addition, the drying chamber and at least the larger portion of the remainder of the mill is generally tubular so that there is not as much room for dispersion of the particles as would be the case with rectangular or trapazoidal cross-sectioned areas. A further difficulty with prior dryers of this type was the nonadjustability of the gaseous fluid nozzles so that the fluids always passed in the same directions regardless of the weight, viscosity, or other physical and chemical characteristics of the materials being processed.

It is one object of the present invention to overcome the aforesaid problems by providing a centrifugal type drying mill which permits effective expansion and dispersion of the particulate mass while preventing the formation of dead spaces not subject to the action of the gaseous fluids.

Another object of the present invention is to provide a drying mill of the aforesaid type wherein the gaseous fluid streams are effective across the entire cross-sectional area of the drying chamber.

Another object of the present invention is to provide a drying mill of the aforesaid type wherein the gaseous fluid streams are capable of adjustment to various desired angles to both vary the angles of the streams in accordance with the type of materials treated and to aid in sweeping the drying chamber clean of any adherent particulate material.

Other objects and many of the attendant advantages of this invention will be readily appreciated as the same becomes better understood by reference to the following description when read in conjunction with the accompanying drawings wherein:

FIG. 1 is a side sectional view of a drying mill embodying the present invention.

FIG. 2 is a sectional view taken on line 2—2 of FIG. 1.

FIG. 3 is a sectional view taken on line 3—3 of FIG. 1.

FIG. 4 is a sectional view taken on line 4—4 of FIG. 1.

FIG. 5 is an enlarged perspective view of one of the gaseous fluid nozzles.

FIG. 6 is an enlarged side sectional view of a nozzle valve.

Referring in greater detail to the figures of the drawings wherein similar reference characters refer to similar parts, there is shown a drying mill, generally designated 10, having an inlet or drying chamber 12, an upstack 14, a classification section 16, a downstack 18 and an exhaust port 20.

The drying chamber 12 has a trapazoidal cross-section (best shown in FIG. 4) wherein the upper wall 22 is wider than the lower wall 24 and the upper and lower walls are connected by inclined side walls 26 and 28. This type of construction permits the drying chamber to act like a funnel to squeeze the material toward the bottom wall where the particles are subject to the direct impact of the hot fluids which are propelled into the chamber through a plurality of nozzles 28. The wet particles are inserted into the drying chamber through any desired feed inlet means, one such means being shown at 30 and comprising a Venturi tube having a nozzle 32 connected to a source of gaseous fluid under pressure (not shown). The gaseous fluid expelled from the nozzle 32 entrains and atomizes the wet particles passing through the inlet 30 from a source (not shown), thereafter propelling them into the chamber.

The nozzles 28 are each connected to a manifold (not shown) or other source of hot gaseous fluid under low pressure, each nozzle 28 being set at a different angle tending toward projecting a combined stream into the upstack 14.

An important aspect of the nozzles 28 is their construction wherein, as best shown in FIG. 5, they are formed with a rectangular slotted opening 34. This slotted opening 34 is situated at the end of a rectangular head portion 36 which is integral with a frusto-conical base portion 38. The rectangular slot 34 extends the full width of the bottom wall 24 of the chamber 26 so that the gaseous fluid propelled from the slot encompasses the full width of the chamber bottom. In this manner all particles are subject to the immediate impingement and entrainment by the same volume of gaseous fluid. This differs from the standard round nozzle head where the area encircling the gaseous stream is not encompassed by the stream so that particles situated in this area are not only not subject to immediate impingement by the gaseous stream but also are drawn against the wall areas and build up theron.

Although not essential to the effective operation of the present mill, each nozzle 28 is provided with a cylindrical valve 40 (as best seen in FIGS. 1 and 6) which comprises a cylinder 42 mounted for rotation between seals 44 which are respectively maintained in place by a flange 46 on one end and a groove 28 in the nozzle wall at the opposite end. The cylinder is mounted on pinions 50 and 52, the pinion 52 being provided with an extension on which is provided a handle 54 for turning the cylinder. An aperture 56 is provided in the cylinder 42 to permit flow therethrough.

The inlet end of the chamber 12, where the feed inlet 30 is located, is provided with a tapered construction, defined by inclined wall portions 58 and 60, the right-hand nozzle 28, as viewed in FIG. 1 being positioned in the wall portion 60. This construction concentrates the feed within that portion of the chamber and eliminates the dead spaces around the feed inlet that are present when that portion of the chamber is as wide as the remainder of the chamber. It is, further, to be noticed that the bottom end portion of the downstack 18 is inclined toward the rear of the chamber 12 to prevent any partially dry particles from the downstack being propelled toward the feed inlet and clogging it.

The construction of the upstack 14 and classification section 16 is of rectangular cross-section, as best seen in FIG. 2, as is also the downstack, as best seen in FIG. 3. The term rectangular is meant to inlude square construction. This permits maximum dispersion and separation of the lighter and heavier particles as they pass around the centrifugal path. The exhaust port 20 is also of rectangular or square cross-section.

The above-described construction concentrates the material where they are most subject to the heat and dispersal action of the hot gases while, at the same time, permitting maximum dispersal and separation in the remainder of the mill. In addition, the adjustable nozzles can be utilized not only to vary the velocity profile or individual directions of the streams of gaseous fluid, but alspo permit them to be individually adjusted so that some can be used to directly entrain the particles while others are used to sweep the chamber clear. It is also possible to shut off one or more nozzles so as to vary the amount and intensity of the gases in the chamber in accordance with the material being treated.

The invention claimed is:

1. A centrifugal drying mill for wet particles comprising an arcuate mill which includes a drying chamber having a feed inlet for particles to be dried and gaseous inlet nozzles, said nozzles being connected to a source of hot gaseous fluid, an upstack connected to one end of said drying chamber, a classification section connected to said upstack, a downstack connected to said classification section, and an exhaust duct extending from the inner periphery of the mill between said classification section and downstack, said downstack being connected to said drying chamber in spaced relation to said feed inlet, said drying chamber having a trapezoidal cross-section including a substantially flat inner peripheral wall and a substantially flat outer peripheral wall, said inner and outer peripheral walls being substantially parallel to each other, said inner peripheral wall being wider than said outer peripheral wall, said nozzles being positioned in said outer peripheral wall, and each of said nozzles having a rectangular nozzle opening that extends across substantially the full width of said outer peripheral wall.

2. The mill of claim 1 wherein said upstack, classification section, downstack and exhaust duct have a rectangular cross-section.

3. The mill of claim 1 wherein said feed inlet is at one end of said drying chamber, opposite the end to which the upstack is connected, said one end being connected to the end of the downstack and to the remainder of the drying chamber by inclined walls, whereby dead spaces between said one end and said downstack and between said one end and the remainder of the drying chamber are eliminated.

4. The mill of claim 1 wherein each of said nozzles is provided with a rotatable nozzle portion having a nozzle passage therein, said nozzle portion being rotatably adjustable to vary the angle of the corresponding nozzle passage or to completely shut said passage.

5. The mill of claim 1 wherein one of said nozzles is positioned in substantially the same plane as said upstack to direct a stream of gaseous fluid directly into said upstack.

* * * * *